US005104611A

United States Patent [19]

Woods et al.

[11] Patent Number: 5,104,611

[45] Date of Patent: Apr. 14, 1992

[54] FLOW BLOCKER FOR ACCESS OPENING

[75] Inventors: Jack L. Woods, Ooltewah, Tenn.; Michael D. Turnmire, Rossville, Ga.

[73] Assignee: Combustion Engineering, Inc., Windsor, Conn.

[21] Appl. No.: 434,641

[22] Filed: Nov. 13, 1989

[51] Int. Cl.[5] ..... G21C 13/06

[52] U.S. Cl. ..... 376/203; 165/96; 165/160; 138/89; 138/92; 138/94

[58] Field of Search ..... 376/203, 204; 165/96, 165/160, 71; 138/89, 92, 94; 220/327

[56] References Cited

U.S. PATENT DOCUMENTS

| | | | |
|---|---|---|---|
| 4,202,732 | 5/1908 | Jung et al. | 176/37 |
| 4,339,054 | 7/1982 | Kellogg | 220/295 |
| 4,624,824 | 11/1986 | Dooley | 376/204 |
| 4,664,178 | 5/1987 | Echols et al. | 165/72 |

FOREIGN PATENT DOCUMENTS

| | | | |
|---|---|---|---|
| 2006077 | 2/1970 | Fed. Rep. of Germany | 165/160 |
| 266394 | 11/1987 | Japan | 165/160 |

*Primary Examiner*—Brooks H. Hunt
*Assistant Examiner*—Chrisman D. Carroll
*Attorney, Agent, or Firm*—John H. Mulholland

[57] ABSTRACT

A nuclear steam generator 10 with economizer 32 adjacent secondary side feedwater inlets **38*a* and 38*b* includes a secondary side divider plate 36 and handholes 40 at opposing 180° locations in alignment with the ends of the plate 36. Notches 42 in the ends of the plate 36 adjacent the aligned handholes 40 facilitate inspection and maintenance access on the secondary side above tubesheet 22. To prevent bypass flow from one side of the divider plate 36 to the other, a novel flow blocker 50 of cylindrical shape is provided for mounting in handholes 40 and notches 42. The flow blocker 50 is defined by telescopically assembled member 52 and 62 which are biased in opposite directions by pre-loaded spring 64 therein to insure stability against vibration and flow induced loads. The flow blocker 50 fits sungly in notch 42 and handhole 40 and is bolted to the inside of closure plate 74 of handhole 40**.

12 Claims, 2 Drawing Sheets

FLOW BLOCKER FOR ACCESS OPENING

BACKGROUND OF THE INVENTION

Nuclear seam generators which have an economizer or preheater section include a physical barrier or flow divider plate to separate the hot inlet fluid from the colder outlet flow areas of the heat exchanger tube bundle on the secondary side of the tubesheet.

A typical nuclear steam generator is a heat exchanger vessel containing a tube sheet which separates a primary side cavity and a secondary side cavity. A bundle of U-shaped tubes is provided with each tube end mounted to extend through the tubesheet in fluid communication with the primary side cavity the to extend into the secondary side cavity to provide a heat exchanging relationship between fluid in the tubes and fluid in the secondary side cavity. The secondary side cavity flow divider plate extents across the vessel and perpendicularly from the tubesheet. Together with other flow directing baffle plates it makes up the economizer or preheater section of the heat exchanger. The economizer improves heat transfer by preheating the incoming feedwater using the low temperature heat transfer portion of the U-tubes, i.e., adjacent where they pass fluid outwardly into the primary cavity outlet side which is separated from the primary cavity inlet side by a divider plate.

The steam generator includes a handhole through the vessel wall adjacent to the tubesheet and divider plate for maintenance and cleaning n the secondary side cavity. Use of the handhole is typically to remove loose parts and debris from be annulus between the vessel inside wall and the tube bundle and to remove sludge on the tubesheet between he tubes, as by lancing.

When an economizer divider plate is present in the steam generator, it obstructs physical access for inspection and maintenance by effectively creating two distinct secondary side cavity portions which would normally require separate handholes for access. A solution to this problem has been to provide the handholes 80° apart at each end of the divider plate in alignment with the plate. A portion of the plate called a "notch" has been removed from the plate end opposite both of the handholes such that the 360° circumference around the tube bundle becomes accessible. During operation, the divider plate notches must be blocked to prevent cross flow from one side of the flow divider plate to the other. The purpose of the flow blocker of the improved heat exchanger of the invention is to seal the notches while the steam generator is in operation yet to be removable for maintenance or inspection.

In providing the flow blocker for use in a nuclear steam generator having an economizer, various design requirements were considered. One design requirement was that the flow blocker must be easy to install and disassemble. Another was that it has to be stable during operation of the steam generator to eliminate problems from vibration and flow loads. A further requirement was the accomplishment of its primary purpose of effectively blocking substantial bypass flow from one side of the divider plate to the other during operation. No prior are device accomplished these objectives.

SUMMARY OF THE INVENTION

The invention is for use in a nuclear heat exchanger of the type which includes an economizer having a flow divider plate and a pair of handholes arranged 80° from each other, at the ends of the divider plate, opposite notches provided in the plate for inspection and maintenance in the secondary side cavity. The essence of the invention is a novel flow blocker for closing the passages between opposite sides of the economizer or secondary side divider plate created by the notches.

The flow blocker structure includes a hollow inner cylindrical member with a recessed end portion and a hollow outer cylindrical member into which sail inner member is telescopically assembler. A spring biases the inner member and the outer member in opposite directions. A central longitudinal member with a hex head in the outer cylindrical member's recessed end portion is threadedly or otherwise fastener to the outer cylindrical member to limit the spring bias's longitudinal telescopic extension of the two members. The recessed portion is of lesser transverse dimension than the divider plate thickness to prevent passage of fluid therethrough and around the plate. A flange on the other cylindrical member has both holes which permit the flow blocker to be attached to a handhole closure plate, as by means of bolts.

The flow blocker's spring biased structure insures stability of the device from vibration and flow loads and ensures a good fit in the notch against the divider plate. To enhance the fit, the plate's opposed notch edges adjacent the vessel are spaced by the diameter of the flow blocker and are arcuate and concentric with the flow blocker and the handhole.

In the preferred embodiment, the spring is preloaded before installation and the flow blocker device is then bolted to the access opening or handhole's removable cover or closure plate. The cover and blocker assembly is then installed such that the flow blocker is in contact with the divider plate notch and centered in the notch and the handhole in alignment herewith so that the flow lane is closed. The access cover closure bolts are then tightened, applying additional load to the spring so that the total spring load is several times greater than the maximum postulated operational loads on the assembly. The spring is designed for a life equal to the steam generator without reducing the preload below the level which guarantees stability against predicted loads. Installation of the flow blocker device is simplified by the bolted construction. As an added precaution against failure, the material for fabrication is a non-corrosion alloy such as ferritic stainless steel.

DETAILED DESCRIPTION OF THE PREFERRED EMBODIMENT

Figure 1:
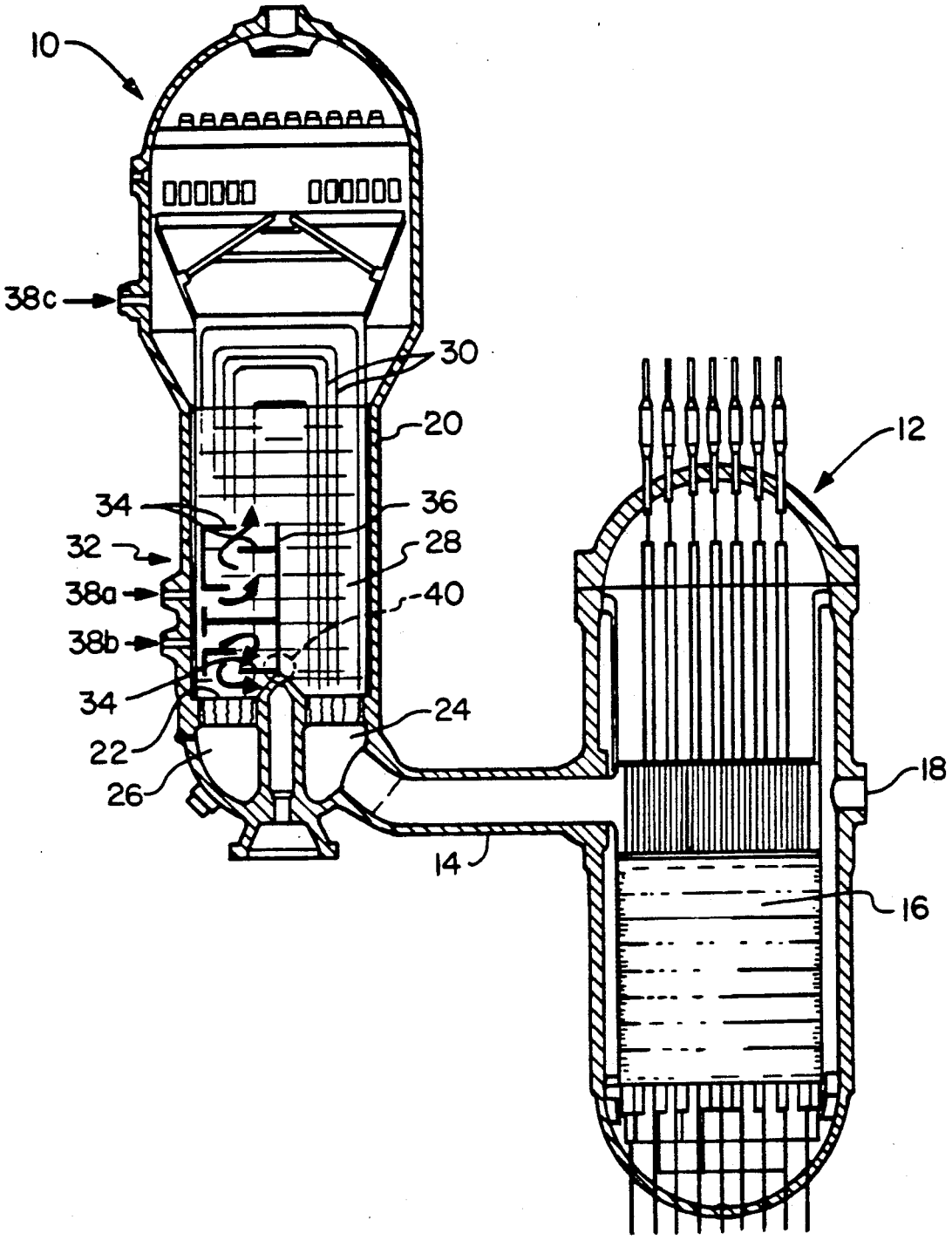
FIG. 1 is a schematic cross-sectional elevational view of a nuclear reactor associated steam generator with an economizer having a notched divider plate within the handholes aligned with be ends of the divider plate and novel flow blocker of the invention mounted within the handholes and notches.
Figure 3:
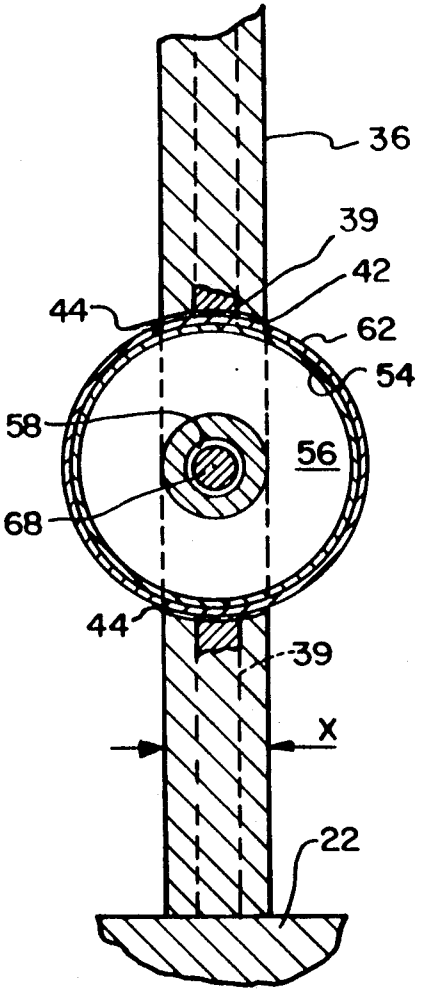
FIG. 3 is a cross-sectional view taken along the line 3—3 of FIG. 2.
Figure 2:
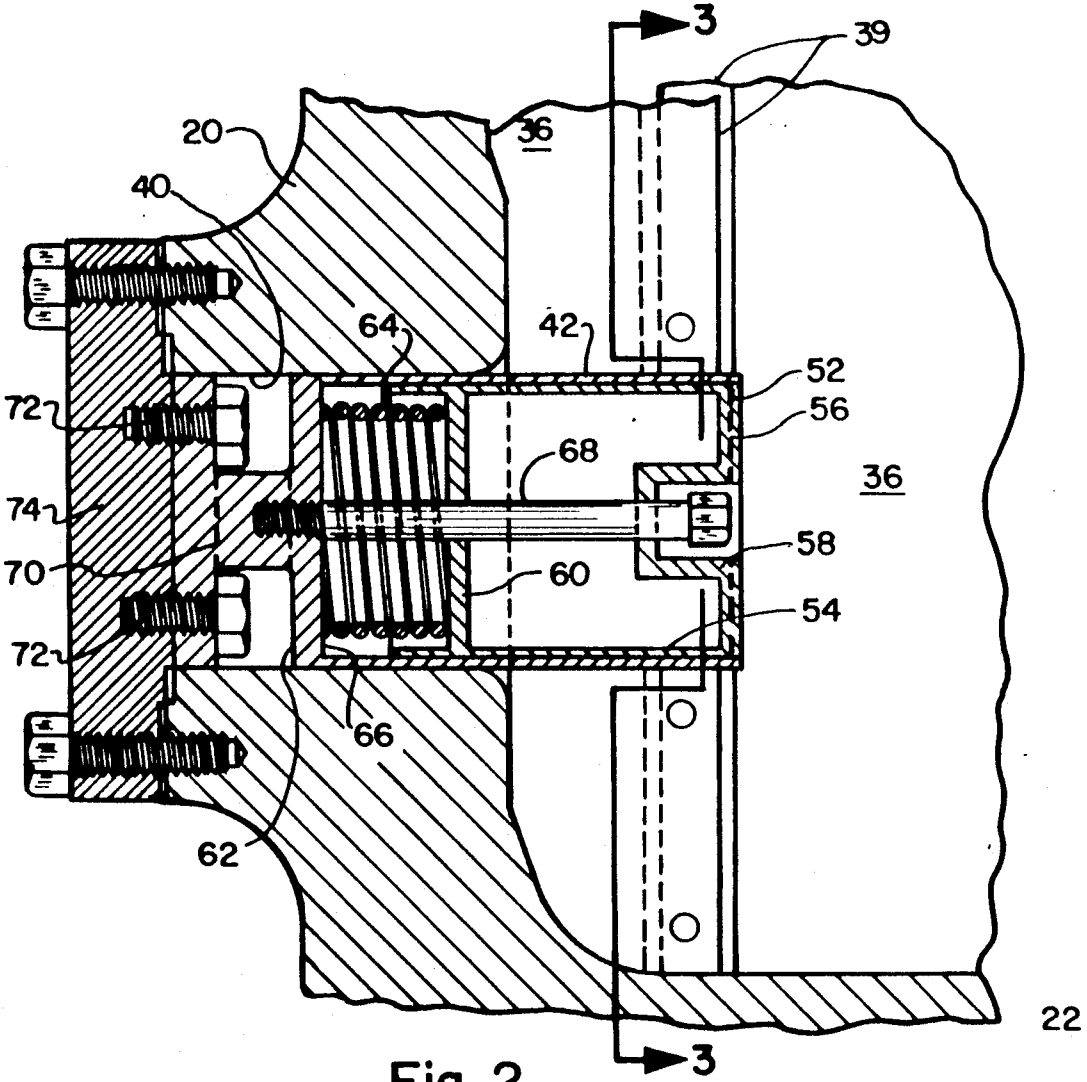
FIG. 2 is a detailed schematic side view of a portion of the secondary side of the steam generator of FIG. 1 showing details of the novel flow blocker in a handhole and divider plate notch.

The numeral 10 generally designates the heat exchanger or steam generator which is part of a nuclear steam supply system. A nuclear reactor, generally designated 2 delivers to fluid through a conduit or hot leg 14 from an active core region 16 in the reactor. The fluid enters the reactor through a primary inlet 18 for circulation through core region 16 and out to the hot leg 14. Other details of reactor 12 are well known and not necessary to the present discussion.

The steam generator 10 has a generally cylindrical vessel 20 which includes a horizontal tubesheet 22. The vessel 20 has a primary side cavity divided by a divider wall (not shown) into an inlet cavity 24 and outlet cavity 26. The hot leg 14 communicates fluid to the primary side inlet cavity 24. Tubesheet 22 separates the primary side cavity portions 24 and 26 from a secondary side cavity 28. A plurality of U-shaped tubes 30 called a "bundle" are mounted in and extend through the tubesheet 22 in fluid communication, with the primary side cavity, each tube with one end in communication with the primary side inlet cavity 24 and the other with the primary side outlet cavity 26. THe tubes 30 extend into the secondary side cavity 28 to provide a heat exchanging relationship between fluid in the tubes 30 and fluid in the secondary side cavity 28.

The secondary side cavity 28 includes an integral "economizer" generally designated by the numeral 32. Economizer 32 is made up of a plurality of baffle plates 34 and passages formed thereby and includes a vertical flow divider plate 36.

The economizer 32 preheats incoming feedwater in the outlet side or cold leg side of the tubes 30 in the secondary side cavity 28 on the opposite side of tubesheet 22 from primary outlet cavity portion 26. The secondary side feedwater enters through an upper feedwater inlet 38*a* and a lower feedwater outlet 38*a*. An auxiliary feedwater inlet 38*c* is of no consequence to the invention description. From the feedwater inlets 38*a* and 38*b*, fluid is distributed 180° circumferentially around the cold leg side of the tube bundle made of U-shaped tubes 30 and radially inwardly beneath flow distribution baffles 34. Annular gaps in the baffles 34 distribute flow evenly above the baffles around the tubes 30 and upwardly through the bundle in counterflow to primary coolant inside the tubes 30. Feedwater is thus preheated for the first portion of its travel above tubesheet 22.

This economizer 32 of the steam generator 10 is separated from the evaporation section in the hot leg side of the tube bundle by a secondary side flow divider plate 36 of with "X" which is attached to the wall of vessel 20 with tongue-and-groove mechanical connections 39 and extends downwardly to the tubesheet 22.

The relocation of secondary side handholes 40 to align with the ends of the secondary side flow divider plate 36 is a significant enhancement for field maintenance. It provides improved access for sludge lancing, for annulus inspection and foreign object search and retrieval.

The present invention recognizes that with the relocation of the handholes, a problem of access to the full circumference of the tube bundle at that elevation could only be solved by providing a notch 42 at each of the ends of the secondary side divider plate 36. The present invention s a flow blocker and a heat exchanger with a flow blocker to prevent fluid bypass around the end of plate 36 through the notches 42.

Each notch 42 is defined by opposed edges 44, which are arcuate and concentric with the adjacent handhole 40. A flow blocker, generally designated 50, is substantially cylindrical, is concentric with the adjacent handhole 40 and notch arcuate surfaces 42 and fits snugly within them. The flow blocker 50 includes a hollow inner cylindrical member 52 having a skirt 54, and end wall 56, with a recess 58, and a centrally apertured transverse flange 60. On the outside of the member 52, telescopically assembled thereto, it a hollow outer cylindrical member 62 into which a spring 64 has been assembled between an outer end wall 66 and the flange 60 of member 52 to bias them in opposite directions. The spring 64 is preloaded by means of a hex-headed rod 68 threaded in end wall 66 of member 62 and seated in recess 58 of member 52. A bolt flange 70 permits attachment of member 62 by means of bolts 72 to a closure plate 74 for handhole 40.

The basic components of the flow blocker device 50 consist of commonly used parts such as cylinders springs, threaded rods and bolts. However, the assembled parts are unique in their arrangement for the purpose being used of allowing previously unattainable ease of access to an economizer secondary side for inspection and maintenance.

We claim:

1. In a heat exchanger having a vessel containing a tubesheet which separates a primary side cavity and a secondary side cavity, tubes mounted in the tubesheet in fluid communication with the primary side cavity and extending through the tubesheet and into the secondary side cavity to provide a heat exchanging relationship between fluid in the tubes and fluid in the secondary side cavity, said secondary side cavity including a flow divider plate an having edges attached to the wall of the vessel and extending toward the tubesheet perpendicularly therewith, and a handhole through the vessel adjacent the divider plate perpendicular edges for maintenance and cleaning in the secondary side cavity and a closure plate for the handhole when the heat exchanger is in operation, the improvement comprising:

said divider plate having a notch in said edge, said handhole being in alignment with said notch, a flow blocker extending from said handhole into said notch dimensioned such that it substantially fills said handhole and said notch and thereby with the flow divider plate prevents substantial flow from one side of the flow divider plate to the other when the heat exchanger is in operation and such that it can be removed from said vessel through said handhole to permit access to both sides of said divider plate for maintenance and cleaning.

2. The improved heat exchanger of claim 1 in which the handhole is adjacent the tubesheet in the secondary side cavity and the divider plate intersects the tubesheet.

3. The improved heat exchanger of claim 1 in which the handhole and the flow blocker are substantially cylindrical and the opposed notch edges adjacent the vessel are spaced by the diameter of the cylindrical flow blocker.

4. The improved heat exchanger of claim 3 in which the opposed notch edges adjacent the vessel are arcuate and concentric with the cylindrical flow blocker and the handhole.

5. The improved heat exchanger of claim 1 in which the flow blocker is attached to the closure plate for the handhole.

6. The improved heat exchanger of claim 1 in which the flow blocker is longitudinally compressible to maintain it in position between the notch and the closure plate.

7. The improved heat exchanger of claim 6 in which the flow blocker comprises two substantially cylindrical members, an inner member and an outer member telescopically assembled and biased in opposite directions by spring means.

8. The improved heat exchanger of claim 7 in which the flow blocker has a longitudinal member limiting the longitudinal telescopic extension of the two members.

9. The improved heat exchanger of claim 1 in which the flow blocker is attached to the closure plate for the handhole.

10. The improved heat exchanger of claim 1 in which the divider plate is part of an economizer of a nuclear steam generator.

11. A flow blocker for closing a passage in a nuclear steam generator having a handhole and a secondary side divider plate of a thickness X comprising in combination:

an inner cylindrical member with a recessed end portion, a hollow outer cylindrical member of greater diameter than thickness X into which said inner member is telescopically assembled, a spring biasing said inner member and said outer member in opposite directions, a longitudinal member limiting the longitudinal telescoping extension of the two members, an end portion of said longitudinal member being located in said recessed end portion of said inner cylindrical member, said recessed end portion of said inner cylinder being of an overall transverse dimension not substantially greater than X.

12. The flow blocker of claim 11 which includes means attaching the outer cylindrical member to a closure plate for a handhole of the nuclear steam generator.

* * * * *